US009052672B2

(12) United States Patent
Tanaka

(10) Patent No.: US 9,052,672 B2
(45) Date of Patent: Jun. 9, 2015

(54) IMAGE FORMING APPARATUS

(71) Applicant: Kyocera Document Solutions Inc., Osaka (JP)

(72) Inventor: Hiroki Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/137,433

(22) Filed: Dec. 20, 2013

(65) Prior Publication Data

US 2014/0178109 A1 Jun. 26, 2014

(30) Foreign Application Priority Data

Dec. 25, 2012 (JP) ..... 2012-281769

(51) Int. Cl.
*G03G 15/01* (2006.01)
*G03G 15/16* (2006.01)
*G03G 15/00* (2006.01)

(52) U.S. Cl.
CPC .... *G03G 15/6585* (2013.01); *G03G 2215/0161* (2013.01); *G03G 15/5058* (2013.01); *G03G 15/5041* (2013.01)

(58) Field of Classification Search
CPC ..... G03G 15/6585; G03G 15/5054; G03G 15/5058; G03G 15/5041; G03G 2215/0158; G03G 2215/0161
USPC ..... 399/301, 49, 72; 347/116
See application file for complete search history.

(56) References Cited

U.S. PATENT DOCUMENTS

2013/0064564 A1* 3/2013 Kubota et al. ..... 399/72
2013/0302048 A1* 11/2013 Sekiguchi et al. ..... 399/49

FOREIGN PATENT DOCUMENTS

JP 2003-114551 A 4/2003

* cited by examiner

*Primary Examiner* — Sophia S Chen
(74) *Attorney, Agent, or Firm* — Studebaker & Brackett PC

(57) ABSTRACT

An image forming apparatus includes an image bearing member, a sensor, a pattern forming section, and a position correction section. The position correction section specifies a first reference position and a second reference position. In a registration correction carried out when the image bearing member is in a time-elapsed state that is a state after the initial state, the position correction section specifies the position of each of the patch images of the respective colors included in the registration correction pattern formed by the pattern forming section at the time of registration correction and corrects based on the first reference position and the second reference position the correction amount to be applied to each image forming position specified in the registration correction currently being carried out.

7 Claims, 10 Drawing Sheets

Initial state (glossiness: high)

Time-elapsed state (glossiness: low)

IMAGE FORMING APPARATUS

The present application claims priority under 35 U.S.C. §119 to Japanese Patent Application No. 2012-281769, filed Dec. 25, 2012. The contents of this application are incorporated herein by reference in their entirety.

BACKGROUND

The present disclosure relates to image forming apparatuses.

Color image forming apparatuses include a plurality of development devices to form a color image with a plurality of color toners. Therefore, a deviation of the imaging positions among the respective colors (so-called color misregistration) may reduce image quality. To address this problem, some image forming apparatuses form a registration pattern that includes patch images of the respective colors on a transfer belt and detect color misregistration based on the times at which the patch images are detected by a sensor.

SUMMARY

An image forming apparatus according to the present disclosure forms an image with toners of a plurality of colors. The image forming apparatus includes an image bearing member, a sensor, a pattern forming section, and a position correction section. The image bearing member bears a registration correction pattern that includes patch images in the respective colors. The sensor directs light to the registration correction pattern formed over the image bearing member and receives light reflected therefrom. The pattern forming section forms the registration correction pattern over the image bearing member. The position correction section specifies positions of the patch images of the respective colors included in the registration correction pattern based on outputs of the sensor corresponding to a surface of the image bearing member and to the registration correction pattern. The position correction section specifies a correction amount to be applied to an image forming position for each of the plurality of colors based on the positions of the patch images of the respective colors. The sensor includes a first photodetector that receives specular reflection components of the reflected light and a second photodetector that receives diffuse reflection components of the reflected light. The position correction section specifies the position of each of the patch images of the respective colors based on a difference between a sensor output by the first photodetector and a sensor output by the second photodetector. The position correction section specifies, as a first reference position, a position of each of the patch images of the respective colors included in the registration correction pattern formed by the pattern forming section when the image bearing member is in an initial state. The pattern forming section forms a black toner layer on the image bearing member to form a registration correction pattern on the black toner layer. The position correction section specifies, as a second reference position, a position of each of the patch images of the respective colors included in the registration correction pattern formed on the black toner layer. In a registration correction carried out when the image bearing member is in a time-elapsed state that is a state after the initial state, the position correction section specifies the position of each of the patch images of the respective colors included in the registration correction pattern that is formed by the pattern forming section at the time of the registration correction and corrects a correction amount specified in the registration correction and to be applied to each of the image forming positions for the respective colors. The correction is performed based on the first reference position and the second reference position.

DETAILED DESCRIPTION

In general, the surface roughness (i.e., light reflection characteristics) of an intermediate transfer belt, on which a registration pattern is formed, may decrease as the print time increases. For example, in the case of an intermediate transfer belt made of a thermoplastic polyurethane (TPU) based elastic material, the decrease in the surface roughness (i.e., light reflection characteristics) over the print time is more noticeable as compared with an intermediate transfer belt made of a polyimide based material, which is relatively hard. In short, such an image bearing member is highly glossy in the initial state, but the glossiness may gradually reduce with use.

Figure 1A:
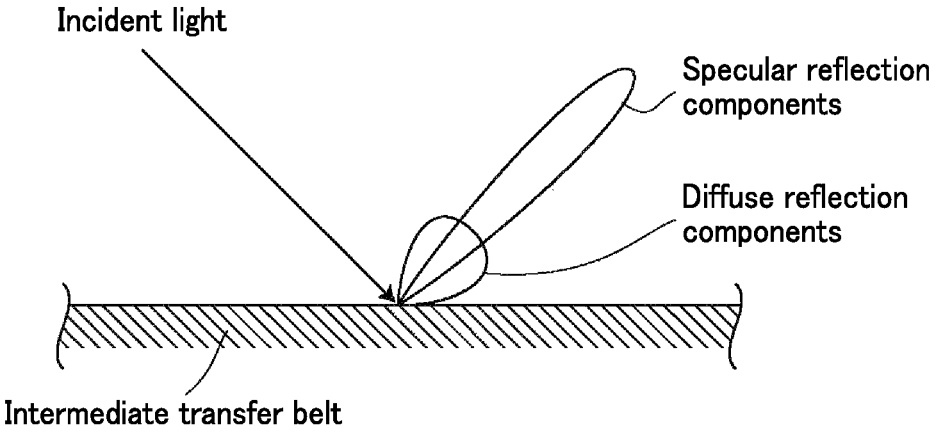
FIGS. 1A and 1B each illustrate the relationship between the glossiness of an intermediate transfer belt and the angular distribution and intensity of the specular and diffuse reflection components of reflected light.
Figure 1B:
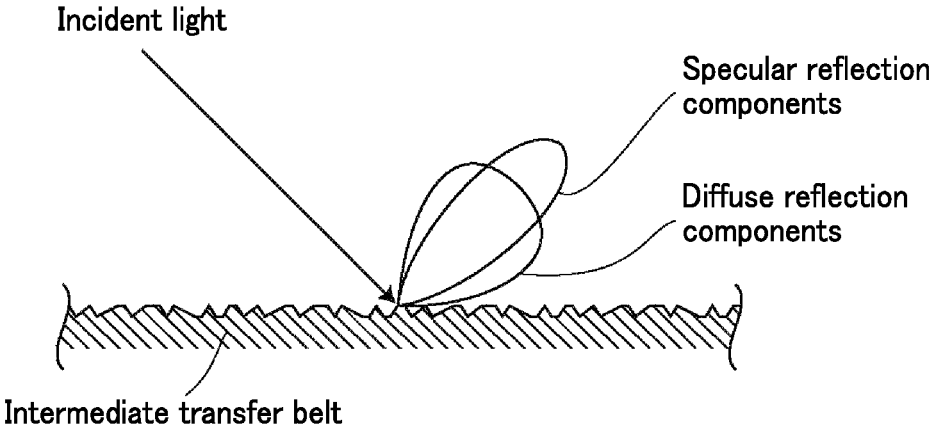

The sensor for detecting the amount of color misregistration directs light to the patch images of the respective colors to detect reflected light with photodetectors, and specifies the position of each patch image based on the times at which the intensity of the reflected light changes. The reflected light includes specular reflection components and diffuse reflection components. As shown in FIG. 1A, the specular reflection components are increasingly intense and narrower in angular distribution as the glossiness of the reflecting surface is higher (i.e., the reflecting surface is smoother). As illustrated in FIG. 1B, on the other hand, the diffuse reflection components are increasingly intense as the glossiness of the reflecting surface is lower (i.e., the reflecting surface is rougher).

Figure 2A:
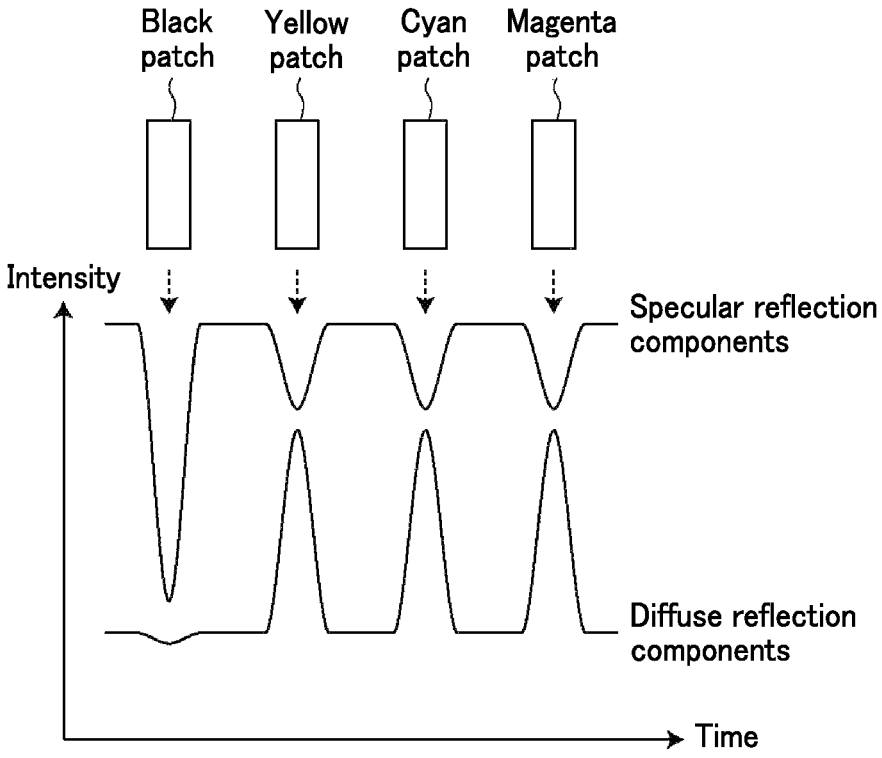
FIGS. 2A and 2B each illustrate the relation between the glossiness of the intermediate transfer belt and the waveforms of sensor outputs representing specular and diffuse reflection components of reflected light.

The glossiness of the intermediate transfer belt is relatively high in the initial state. Therefore, as illustrated in FIG. 2A, light reflected from where no patch image is located (in other words, from the surface material of the intermediate transfer belt) contains a large amount of specular reflection components and a small amount of diffuse reflection components.

Figure 2B:
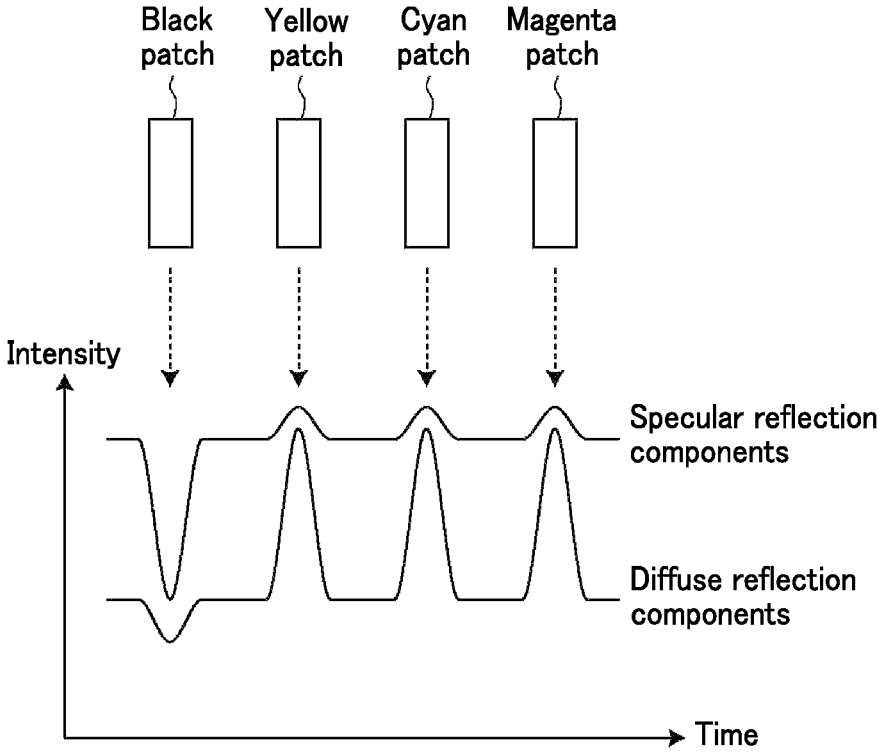

Eventually, the glossiness of the intermediate transfer belt gradually reduces with use as illustrated in FIG. 2B, so that light reflected from where no patch image is located (i.e., from the surface material of the intermediate transfer belt) contains a smaller amount of specular reflection components and a greater amount of diffuse reflection components as compared with those contained in reflected light from the intermediate transfer belt in the initial state.

As described above, it generally occurs that the light reflection characteristics of the surface of the intermediate transfer belt changes over time. As a result, the difference in intensity between light reflected from a patch image and that from the surface material of the intermediate transfer belt may be reduced as illustrated in FIG. 2B. This can make it difficult to accurately detect the positions of patch images.

Figure 3:
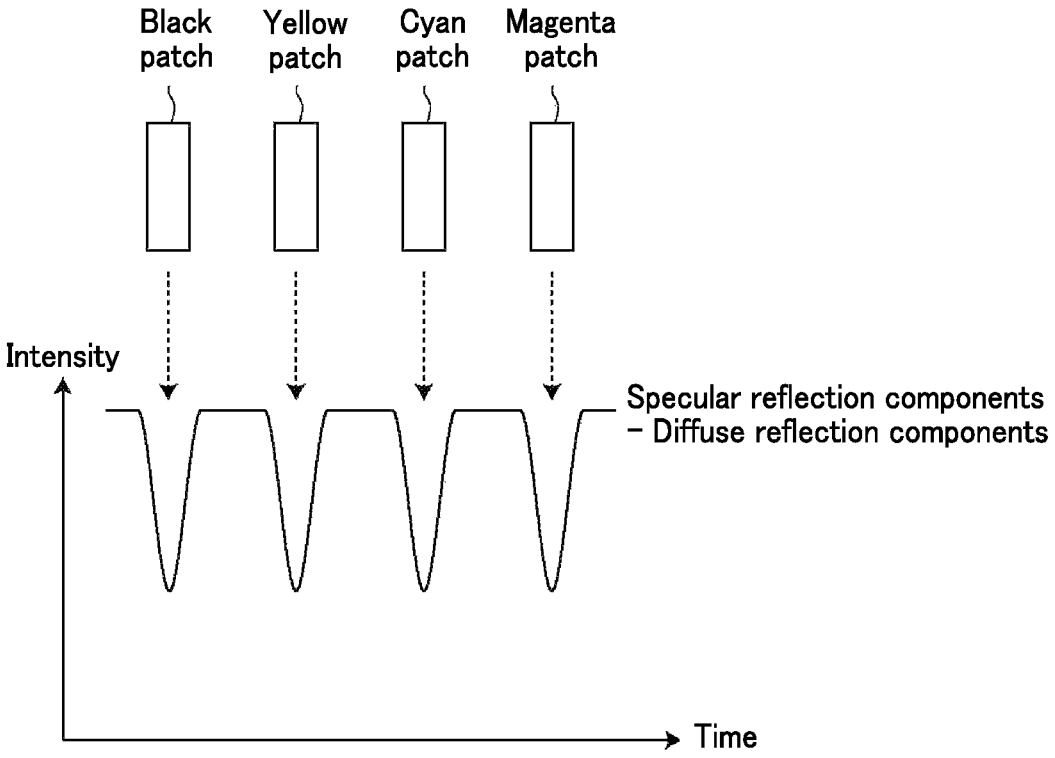
FIG. 3 shows a waveform representing the difference between the specular and diffuse reflection components of reflected light.

For this reason, the position of a patch image is detected based on the intensity difference between the specular and diffuse reflection components. Use of the intensity difference between the specular and diffuse reflection components can increase the difference between a detection value for a patch image and that for the surface of the intermediate transfer belt as shown in FIG. 3, even when the glossiness of the intermediate transfer belt is low. This facilitates the position of a patch image to be accurately detected with reference to a waveform yielded by binarizing the differences.

Besides, the sensor used for detecting the amount of color misregistration may involve fluctuations in the angles of the optical axes and the distances to the photodetectors. Such fluctuations may cause a phase shift between the sensor output waveforms representing the specular and diffuse light reflection components.

Figure 4:
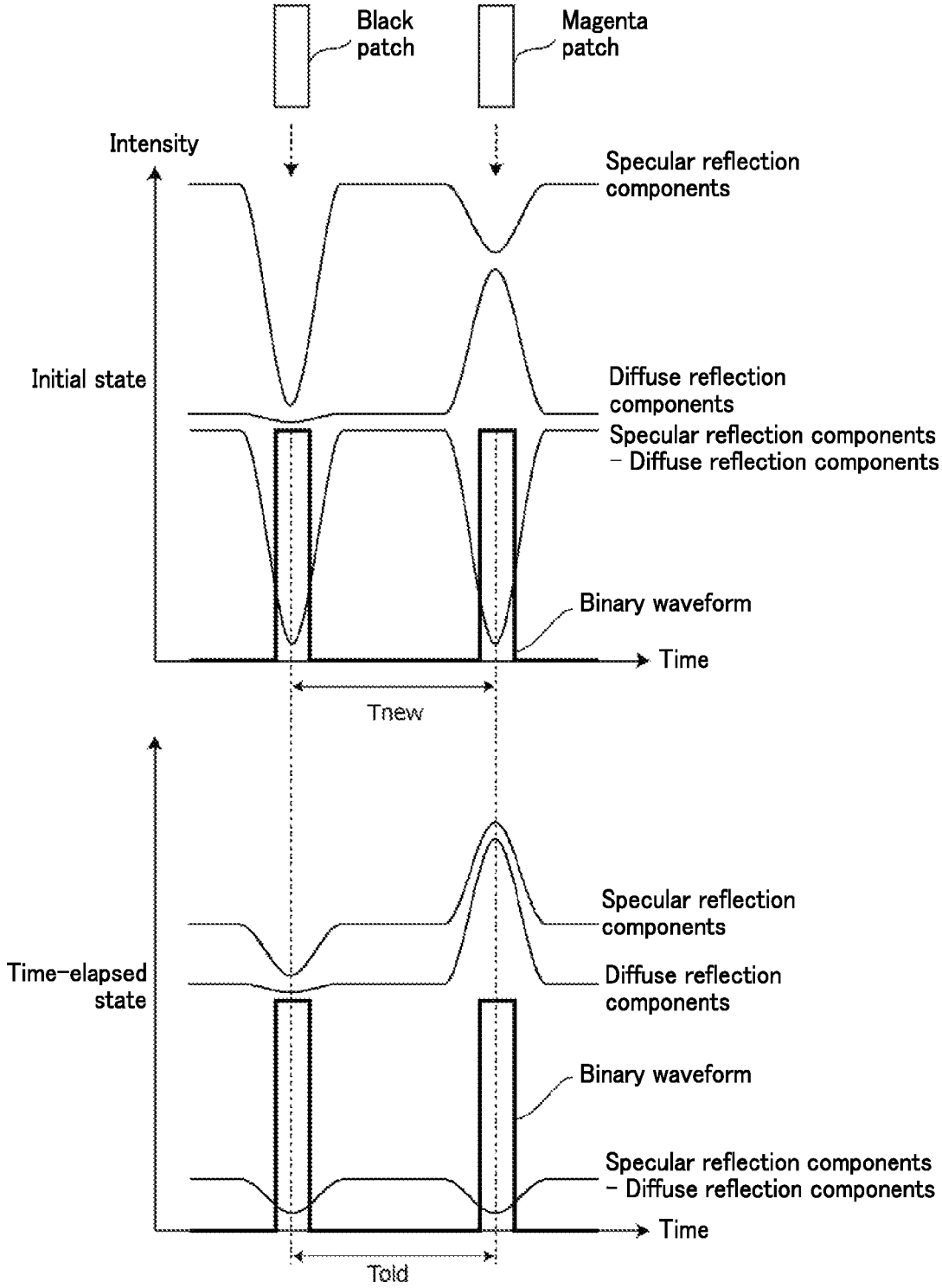
FIG. 4 illustrates time-varying change in an interval between detection times of patch images in the absence of a phase shift between the specular and diffuse reflection components of reflected light.
Figure 5:
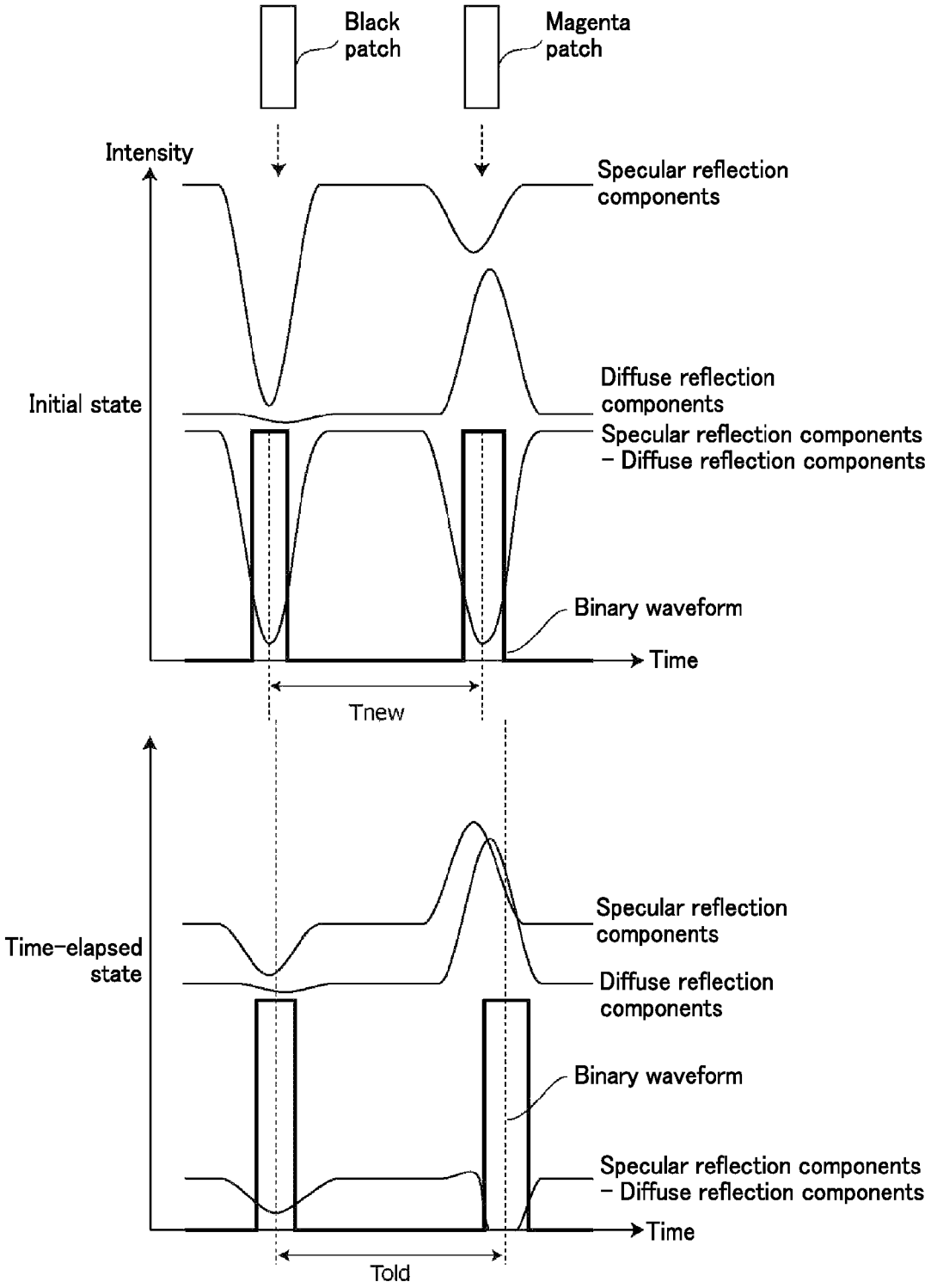
FIG. 5 illustrates time-varying change in an interval between detection times of patch images in the presence of a phase shift between the specular and diffuse reflection components of reflected light.

In the absence of such a phase shift as illustrated in FIG. 4, it is generally true that the time period from the detection of a black patch image to the detection of a color patch image (that is, the time period corresponding to the distance between the patch images) remains substantially the same between the initial state (Tnew) and the time-elapsed state (Told). By contrast, in the presence of such a phase shift as illustrated in FIG. 5, the time period from the detection of a black patch image to the detection of a color patch image (that is, the time period corresponding to the distance between the patch images) is longer in the time-elapsed state (Told) than in the initial state (Tnew). This change over time in the light reflection characteristics of the intermediate transfer belt may cause an error in a detected position.

The following now describes an embodiment of the present disclosure with reference to the accompanying drawings.

Figure 6:
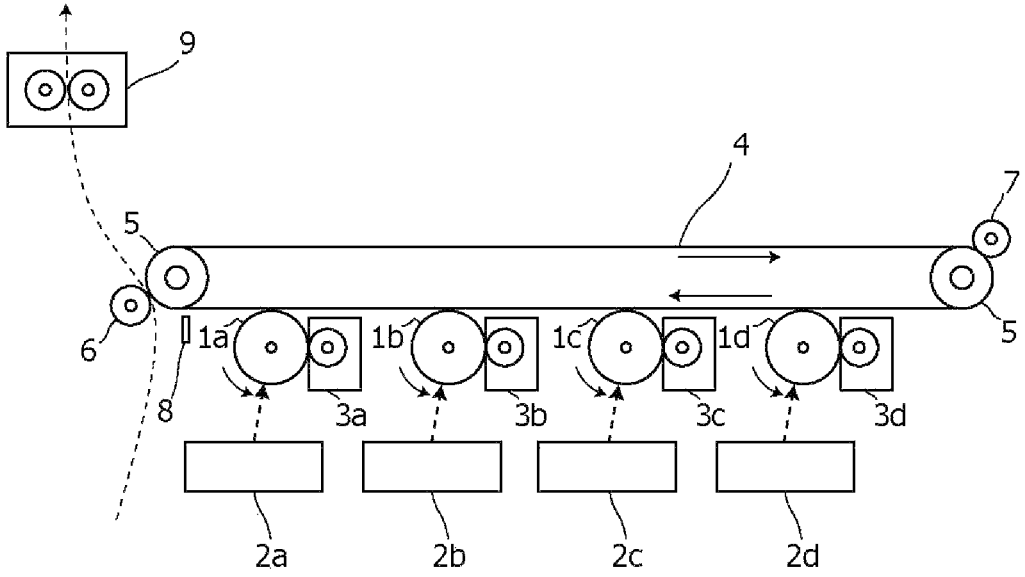
FIG. 6 is a side view showing a part of the internal, mechanical configuration of an image forming apparatus according to one embodiment of the present disclosure.

FIG. 6 is a side view showing a part of the internal mechanical configuration of an image forming apparatus according to the embodiment of the present disclosure. The image forming apparatus has an electrophotographic printing function and typically is a printer, facsimile machine, copier, multifunction peripheral, etc.

The image forming apparatus according to the present embodiment includes a tandem-type color developer. The color developer includes photosensitive drums 1*a*-1*d*, exposure devices 2*a*-2*d*, and development devices 3*a*-3*d* for respective colors. The photosensitive drums 1*a*-1*d* are photoreceptors for four colors, namely, cyan, magenta, yellow, and black. The exposure devices 2*a*-2*d* irradiate the photosensitive drums 1*a*-1*d* with laser light to form electrostatic latent images. The exposure devices 2*a*-2*d* each include a laser diode, which is the source of laser light, and optical elements (such as a lens, mirror, polygon mirror, etc.) to direct the laser light to a corresponding one of the photosensitive drums 1*a*-1*d*.

Further, the photosensitive drums 1*a*-1*d* are each surrounded by an electrostatic charger, a cleaning device, a static eliminator, etc. The electrostatic chargers charge the photosensitive drums 1*a*-1*d* by a scorotron, for example. The cleaning devices remove residual toner from the surfaces of photosensitive drums 1*a*-1*d* after primary transfer. The static eliminators neutralize the photosensitive drums 1*a*-1*d* after the primary transfer.

The development devices 3*a*-3*d* are each fitted with a toner container filled with toner of a corresponding one of the four colors, namely cyan, magenta, yellow, and black. A developing bias is applied across each of the development devices 3*a*-3*d* and a corresponding one of the photosensitive drums 1*a*-1*d*. The development devices 3*a*-3*d* cause toner, which is supplied from the respective toner containers, to adhere to the electrostatic latent images formed on the photosensitive drums 1*a*-1*d*. As a result, toner images are formed. For example, the toner forms a developing agent in combination with carrier. The toner additionally includes an external additive, such as titanium oxide.

The photosensitive drum 1*a*, exposure device 2*a*, and development device 3*a* cooperate to develop an image in magenta. The photosensitive drum 1*b*, exposure device 2*b*, and development device 3*b* cooperate to develop an image in cyan. The photosensitive drum 1*c*, exposure device 2*c*, and development device 3*c* cooperate to develop an image in yellow. The photosensitive drum 1*d*, exposure device 2*d*, and development device 3*d* cooperate to develop an image in black.

An intermediate transfer belt 4 is in contact with the photosensitive drums 1*a*-1*d*. The intermediate transfer belt 4 is an endless (i.e., looped) intermediate transfer body onto which toner images formed on the photosensitive drums 1*a*-1*d* are primarily transferred and thus serves as an image bearing member. The intermediate transfer belt 4 is wound around a pair of drive rollers 5. The intermediate transfer belt 4 is rotated by drive power from the drive rollers 5 in the direction from the contact position with the photosensitive drum 1*d* to the contact position with the photosensitive drum 1*a*.

The intermediate transfer belt 4 in the present embodiment is made of thermoplastic polyurethane.

A transfer roller 6 brings a paper sheet conveyed thereto into contact with the intermediate transfer belt 4 to cause the secondary transfer of the toner images on the intermediate transfer belt 4 to the paper sheet. It is noted that the paper sheet onto which the toner images are transferred is conveyed to a fixing device 9 that fixes the toner images to the paper sheet.

A roller 7 is provided with a cleaning brush and brings the brush into contact with the intermediate transfer belt 4 to remove residual toner from the intermediate transfer belt 4 after the transfer of the toner images to the paper sheet.

A pair of sensors 8 detects the toner density by irradiating the intermediate transfer belt 4 with a light beam to detect the reflected light. In toner density adjustment and registration correction, each sensor 8 directs the light beam toward a predetermined region where a test pattern (more specifically, toner patch images, which will be described later) formed over the intermediate transfer belt 4 passes, detects light reflected therefrom, and outputs an electric signal according to the amount of light detected.

Figure 7:
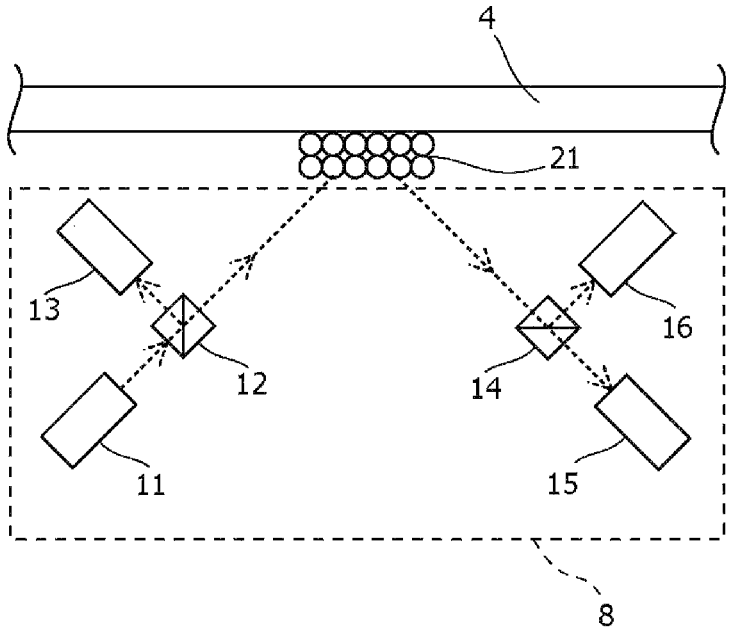
FIG. 7 shows a configuration example of a sensor shown in FIG. 6.

FIG. 7 shows a configuration example of one of the sensors 8 shown in FIG. 6.

As shown in FIG. 7, the sensor 8 includes a light source 11 that emits a light beam, a beam splitter 12 and a photodetector 13, both of which are located on the light source side, and also includes a beam splitter 14, a first photodetector 15, and a second photodetector 16, all of which are located on the light receiving side.

For example, the light source 11 is a light-emitting diode. The beam splitter 12 transmits the P-polarized components while reflecting the S-polarized components of the light beam emitted from the light source 11. For example, the photodetector 13 on the light source side is a photodiode. The photodetector 13 on the light source side detects the S-polarized components transmitted through the beam splitter 12 and outputs an electric signal according to the amount of light detected. The electric signal is used for control to stabilize the amount of light to be output from the light source 11.

The P-polarized components transmitted through the beam splitter 12 on the light source side reach the surface of the intermediate transfer belt 4 (a toner pattern 21 or the surface material) to be reflected. The reflected light at this time is formed of specular reflection components and diffuse reflection components. The specular reflection components constitute P-polarized light.

The beam splitter 14 transmits the P-polarized reflection components (specular reflection components) while reflecting the S-polarized components of the reflected light. For example, the first photodetector 15 is a photodiode. The first photodetector 15 detects the P-polarized components (specular reflection components) transmitted through the beam splitter 14 and outputs an electric signal at a voltage according to the amount of light detected. For example, the second photodetector 16 is a photodiode. The second photodetector 16 has light detection characteristics similar to those of the first photodetector 15. The second photodetector 16 detects the S-polarized components (diffuse reflection components) reflected by the beam splitter 14 and outputs an electric signal at a voltage according to the amount of the light detected.

Due to the fluctuations in the angles of the respective optical axes of the light source 11 and the photodetectors 15 and 16 as well as in the distances from the beam splitter 14 to the respective photodetectors 15 and 16, a phase shift is caused between the waveform of sensor output regarding the specular reflection components and the waveform of sensor output regarding the diffuse reflection components.

Figure 8:
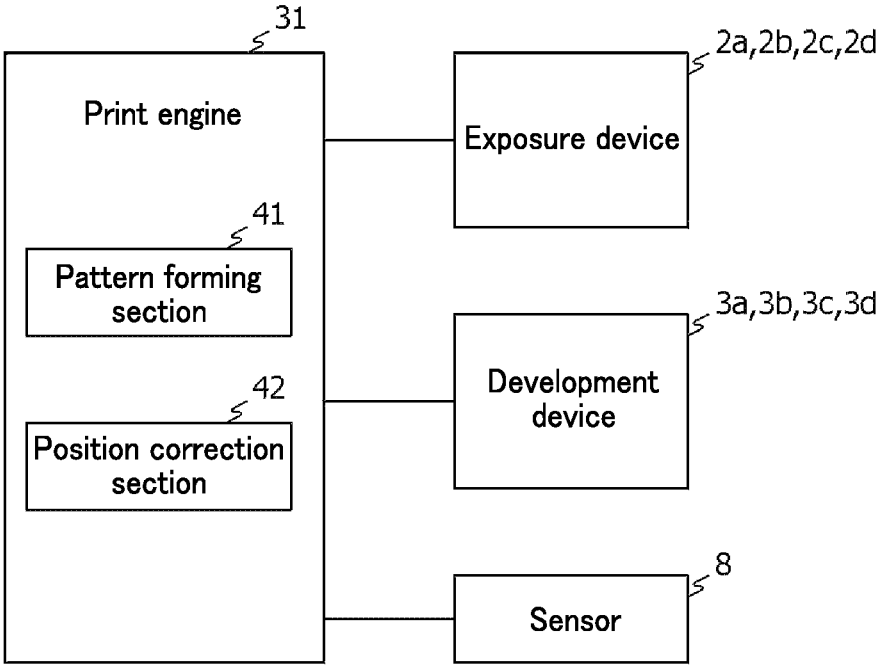
FIG. 8 is a block diagram showing a part of an electrical configuration of the image forming apparatus according to one embodiment of the present disclosure.

FIG. 8 is a block diagram showing a part of the electrical configuration of the image forming apparatus according to one embodiment of the present disclosure. A print engine 31 shown in FIG. 8 controls a power supply and a bias circuit (both of which are not shown), the development devices 3*a*-3*d*, the exposure devices 2*a*-2*d*, and on the like. The power supply drives the rollers and the like described above. The bias circuit applies a primary transfer bias. The print engine 31 is a processing circuit for execution of various processes, including development, transfer, and fixing of toner images, paper feed, printing, and paper ejection. The primary transfer bias is applied across the respective photosensitive drums 1*a*-1*d* and the intermediate transfer belt 4.

Further, the print engine 31 also specifies the toner density and the glossiness of the surface material of the intermediate transfer belt 4 and of the toner layer based on the outputs of the sensors 8. At the time of registration correction, the print engine 31 specifies the positions of patch images in the respective colors included in a registration pattern.

The print engine 31 in the present embodiment specifies the positions of the patch images of the respective colors included in a registration pattern, which is formed at the time of registration correction, based on the outputs of the first and second photodetectors 15 and 16. An amplifier or the like may be additionally provided between each of the photodetectors 15 and 16 and the print engine 31 as needed.

For example, the toner density is given by the following expression.

$$\text{Toner density}(\%)=\{1-(P-S)/(Po-So)\}\times 100$$

In the expression, P denotes a sensor output value (voltage) for P-polarized components; S denotes a sensor output value (voltage) for S-polarized components; Po denotes a sensor output value (voltage) for P-polarized components reflected from where no toner image is located (i.e., from the surface material of the intermediate transfer belt 4); and So denotes a sensor output value (voltage) for S-polarized components reflected from where no toner image is located (i.e., from the surface material of the intermediate transfer belt 4).

The glossiness is defined as the ratio or difference between the sensor output value (voltage) of the P-polarized components and the sensor output value (voltage) of the S-polarized components.

The print engine 31 executes registration correction periodically or with predetermined timing to correct the image forming positions for the respective colors. In the registration correction, the scan start timing and the number of scanning lines of the exposure devices 2*a*-2*d* are adjusted so as to ensure that toner images of the respective colors are formed at their appropriate positions.

The print engine 31 includes a pattern forming section 41 and a position correction section 42.

The pattern forming section 41 controls the exposure devices 2*a*-2*d*, the development devices 3*a*-3*d*, and the like to control the image forming positions for the respective toner colors based on the correction amounts currently determined for the respective image forming positions. The pattern forming section 41 forms a registration correction pattern over the intermediate transfer belt 4. The registration correction pattern includes patch images of the respective colors. The sensors 8 direct light to the registration correction pattern formed over the intermediate transfer belt 4 to receive light reflected therefrom.

The position correction section 42 specifies the position of each patch image in the registration correction pattern based on the outputs of the sensors 8 corresponding to the surface of the intermediate transfer belt 4 and the registration correction pattern. The position correction section 42 specifies the correction amount to be applied to the image forming position for each color, based on the position of the patch image of the corresponding color.

The position correction section 42 compares the difference between the output of the first photodetector 15 and the output of the second photodetector 16 to a predetermined threshold thereby to yield the binary waveform. The position of each patch image is specified based on the timing of a rising or falling edge or the both edges (such as the midpoint between the two edges) in the binary waveform.

When the intermediate transfer belt 4 is in the initial state (i.e., when the image forming apparatus is first used or when the intermediate transfer belt 4 is replaced), the position correction section 42 specifies, as a first reference position, the position of each of the patch images of the respective colors included in the registration correction pattern formed by the pattern forming section 41.

In addition, the pattern forming section 41 forms a black toner layer on the intermediate transfer belt 4 and forms a registration correction pattern on the black toner layer. Then, the position correction section 42 specifies, as a second reference position, the position of each of the patch images of the respective colors included in the registration correction pattern formed on the black toner layer. It is noted that the black toner layer is formed to be larger in area than the registration correction pattern and thus exposed to be visible around each patch image included in the registration correction pattern.

In the registration correction carried out when the intermediate transfer belt 4 is in the time-elapsed state, which is the state after the initial state, the position correction section 42 additionally specifies the position of each of the patch images of the respective colors included in the registration correction pattern that is formed by the pattern forming section 41. Based on the first and second reference positions, the position correction section 42 corrects the correction amount to be applied to the image forming position that is specified for each color in the registration correction currently being carried out.

Based on the outputs of the sensors 8, in addition, the position correction section 42 specifies the glossiness of the intermediate transfer belt 4 in the initial state as the first reference glossiness, specifies the glossiness of the black toner layer as the second reference glossiness, and specifies the glossiness of the intermediate transfer belt in the registration correction carried out when the intermediate transfer belt 4 is in the time-elapsed state, which is the state after the initial state. Based on the glossiness of the intermediate transfer belt 4 at the time of registration correction, the first reference glossiness, and the second reference glossiness, the position correction section 42 corrects the correction amount to be applied to the image forming position of a corresponding color specified in the current registration correction.

For example, the position correction section 42 associates each first reference position with a corresponding first reference glossiness, and each second reference position with a corresponding second reference glossiness. Then, based on the association, the position correction section 42 specifies the deviation from the first or second reference position corresponding to the glossiness detected in the registration correction. The position correction section 42 corrects the correction amount specified in the registration correction for each image forming position by the amount corresponding to the deviation.

The following is a description of operation of the image forming apparatus.

Figure 9:
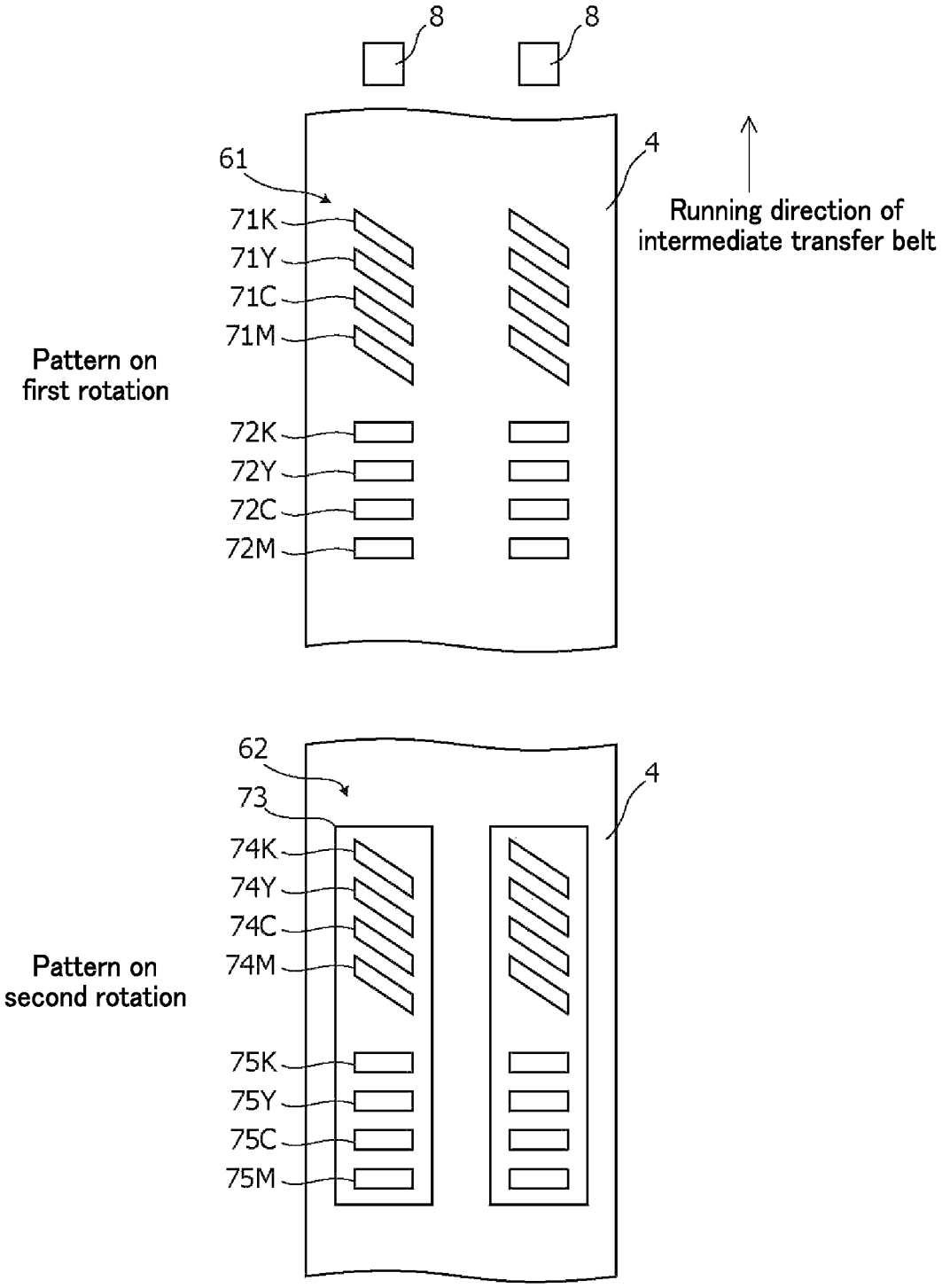
FIG. 9 shows one example of a registration correction pattern used in the image forming apparatus shown in FIG. 6.
Figure 10:
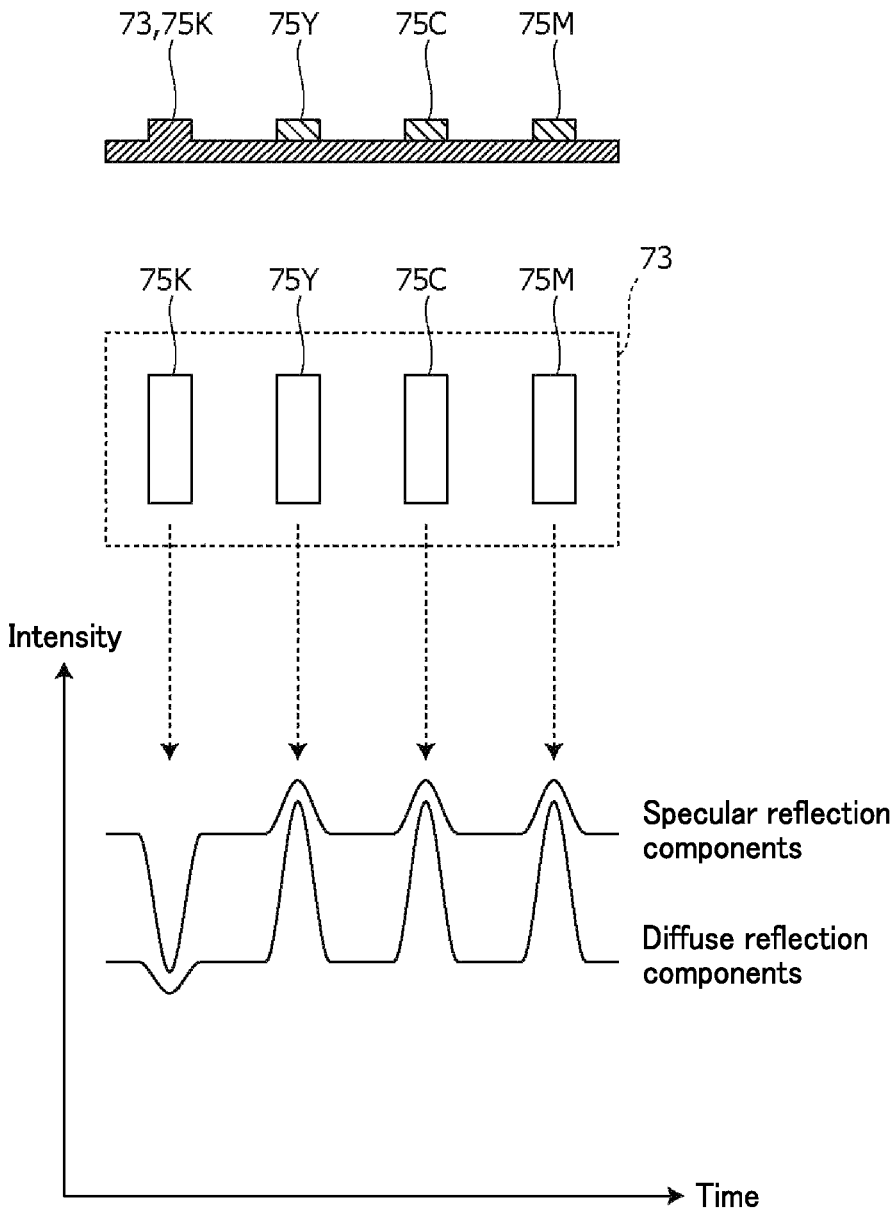
FIG. 10 illustrates patch images formed on a black toner layer as shown in FIG. 9 and the waveforms of sensor outputs obtained from the patch images.
Figure 11:
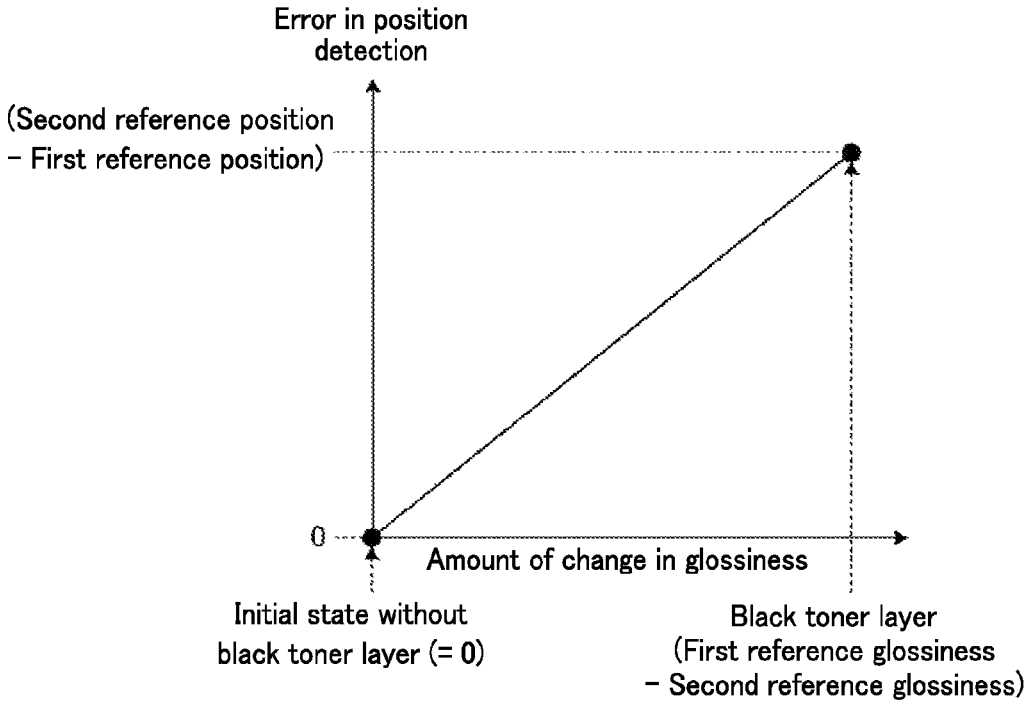
FIG. 11 illustrates an amount of error in position detection of patch images plotted against the amount of change in glossiness of the intermediate transfer belt of the image forming apparatus shown in FIG. 6.

FIG. 9 shows one example of a registration correction pattern used in the image forming apparatus shown in FIG. 6. FIG. 10 illustrates the patch images formed on the black toner layer as shown in FIG. 9 and the waveforms of the sensor outputs obtained from the patch images. FIG. 11 illustrates the error in the position detection of the patch images, in relation to the amount of change in glossiness of the intermediate transfer belt 4 of the image forming apparatus shown in FIG. 6.

First, the pattern forming section 41 forms a registration correction pattern 61 with no black toner layer as shown in FIG. 9 during the first rotation of the intermediate transfer belt 4 in the initial state. The registration correction pattern 61 includes pairs of patch images 71K, 71Y, 71C, and 71M and pairs of patch images 72K, 72Y, 72C, and 72M.

The patch images 71K, 71Y, 71C, and 71M are toner patch images of black, yellow, cyan, and magenta for correcting color misregistration in the main scanning direction (the width direction of the intermediate transfer belt 4). The patch images 72K, 72Y, 72C, and 72M are toner patch images of black, yellow, cyan, and magenta for correcting color misregistration in the sub-scanning direction (the running direction of the intermediate transfer belt 4). Color misregistration in the main scanning direction is corrected based on the positions of the patch images 71K, 71Y, 71C, and 71M corresponding to one color and the positions of the patch images 72K, 72Y, 72C, and 72M corresponding to another color. Color misregistration in the sub-scanning direction is corrected based on the positions of the patch images 72K, 72Y, 72C, and 72M.

It is noted that the patch images 71K, 71Y, 71C, and 71M and the patch images 72K, 72Y, 72C, and 72M are formed at a 100% density.

Based on the outputs of the sensors 8, the position correction section 42 specifies the positions of the patch images 71K, 71Y, 71C, and 71M as well as of the patch images 72K, 72Y, 72C, and 72M (that is, the first reference positions) and also specifies the glossiness of the surface material of the intermediate transfer belt 4 in the initial state (that is, the first reference glossiness).

Next, during the second rotation of the intermediate transfer belt 4 (after removal of the registration correction pattern 61 formed during the first rotation described above), the pattern forming section 41 forms a registration correction pattern 62 on a black toner layer 73 as shown in FIGS. 9 and 10. The registration correction pattern 62 includes pairs of patch images 74K, 74Y, 74C, and 74M and pairs of patch images 75K, 75Y, 75C, and 75M.

Similarly to the patch images 71K, 71Y, 71C, and 71M, the patch images 74K, 74Y, 74C, and 74M are toner patch images of black, yellow, cyan, and magenta for correcting color misregistration in the main scanning direction. Similarly to the patch images 72K, 72Y, 72C, and 72M, the patch image 75K, 75Y, 75C, and 75M are toner patch images of black, yellow, cyan, and magenta for correcting color misregistration in the sub-scanning direction.

It is noted that the patch images 74K, 74Y, 74C, and 74M as well as the patch images 75K, 75Y, 75C, and 75M are formed at a 100% density. The black toner layer 73 is formed at a predetermined density that is lower than the density of the black patch images 74K and 75K.

Based on the outputs of the sensors 8, the position correction section 42 specifies the positions of the patch images 74K, 74Y, 74C, and 74M and the patch images 75K, 75Y, 75C, and 75M (that is, the second reference positions) and also specifies the glossiness of the black toner layer 73 (at a portion where none of the patch images 74K, 74Y, 74C, and 74M and patch images 75K, 75Y, 75C, and 75M is overlaid and thus the black toner layer 73 is exposed) (that is, the second reference glossiness).

As shown in FIG. 10, the outputs of the sensors 8 (regarding the specular and diffuse reflection components) corresponding to the black toner layer 73 at this time exhibits the tendency similar to the outputs of the sensors 8 (regarding the specular and diffuse reflection components) corresponding to the surface material of the intermediate transfer belt 4 with an extremely low glossiness.

In the manner described above, the pattern forming section 41 and the position correction section 42 specify the first and the second reference positions for a toner image of each color and also specify the glossiness of the intermediate transfer belt 4 (the first reference glossiness) and of the black toner layer (the second reference glossiness) in the initial state.

The position correction section 42 generates a relational expression or table for specifying the amount of detection error corresponding to the glossiness of the intermediate transfer belt 4 and stores the resulting expression or table in non-volatile memory, for example. Note that the relational expression or table is defined from the relationship between the first reference glossiness and the second reference glossiness and the relationship between the first reference position and the second reference position. For example, the relational expression or table defining a relationship between the amount of error in position detection and the amount of change from the first reference glossiness is defined as shown in FIG. 11.

Note that the relational expression or table is generated for each of the main scanning direction and the sub-scanning direction. Further, the relational expression or table is generated only once per intermediate transfer belt 4 (for example, only once at the time when the belt is replaced).

Then, at the time of registration correction, the pattern forming section 41 forms a registration correction pattern 61 on the intermediate transfer belt 4 with no black toner layer similarly to the one formed during the first rotation as shown in FIG. 9.

Based on the outputs of the sensors 8, the position correction section 42 specifies the position of the patch images 71K, 71Y, 71C, and 71M and the patch images 72K, 72Y, 72C, and 72M that are included in the registration correction pattern 61 and also specifies the glossiness of the surface material of the intermediate transfer belt 4 (glossiness in the time-elapsed state).

The position correction section 42 specifies the amount of error in position detection corresponding to the thus specified glossiness by using the relational expression or table described above, and then corrects the positions of the patch images 71K, 71Y, 71C, and 71M and patch images 72K, 72Y, 72C, and 72M each by the thus specified amount of error in position detection. In this way, the correction amount to be applied to the image forming positions of the respective colors in the current registration correction is specified.

Thereafter, the print engine 31 causes toner images of the respective colors to be formed each at the image forming position determined by applying the correction amount as specified. This correction amount is used until the next registration correction takes place.

According to the present embodiment described above, the position correction section 42 specifies, as the first reference positions, the positions of the patch images of the respective colors included in the registration correction pattern 61 formed by the pattern forming section 41 when the intermediate transfer belt 4 is in the initial state. Also, the position correction section 42 specifies, as the second reference positions, the positions of the patch images of the respective colors included in the registration correction pattern 62 formed on the black toner layer 73.

Each sensor 8 includes the first photodetector 15 for receiving the specular reflection components of reflected light and the second photodetector 16 for receiving the diffuse reflection components of the reflected light. The position correction section 42 specifies the position of each of the patch images of the respective colors based on the difference between the sensor output by the first photodetector 15 and the sensor output by the second photodetector 16.

The position correction section 42 then specifies the positions of the patch images of the respective colors included in the registration correction pattern that is formed by the pattern forming section 41 in the registration correction carried out when the intermediate transfer belt 4 is in the time-elapsed state. The position correction section 42 corrects the correction amount specified, in the registration correction, to be applied to the image forming position for each color based on the first and second reference positions.

Thus, the registration correction can be carried out accurately regardless of a phase shift between the sensor output by the first photodetector 15 and the sensor output by the second photodetector 16 and of time-varying change in the light-reflecting characteristics of the intermediate transfer belt 4.

Although the embodiment described above is examples, the present disclosure is not limited to these specific examples, and various modifications and changes may be made without departing from the gist of the present disclosure.

For example, the embodiment described above may be modified so as to form a plurality of black toner layers 73 with different densities. Then, the position correction section 42 may specify the reference glossiness of each black toner layer 73 of a different density and the reference position of each patch image in a manner described above and adjust the correction amount to be applied to each image forming position in the registration correction with reference to the thus specified reference glossiness and reference position.

What is claimed is:

1. An image forming apparatus for forming an image with toners of a plurality of colors, comprising:

an image bearing member configured to bear a registration correction pattern that includes patch images in the respective colors;

a sensor configured to direct light to the registration correction pattern formed over the image bearing member and receive light reflected therefrom;

a pattern forming section configured to form the registration correction pattern over the image bearing member; and a position correction section configured to specify positions of the patch images of the respective colors included in the registration correction pattern based on outputs from the sensor corresponding to a surface of the image bearing member and to the registration correction pattern, and specify a correction amount to be applied to an image forming position for each of the plurality of colors based on the positions of the patch images of the respective colors, wherein the sensor includes a first photodetector configured to receive specular reflection components of the reflected light and a second photodetector configured to receive diffuse reflection components of the reflected light, the position correction section specifies the position of each of the patch images of the respective colors based on a difference between a sensor output by the first photodetector and a sensor output by the second photodetector, the position correction section specifies, as a first reference position, a position of each of the patch images of the respective colors included in the registration correction pattern formed by the pattern forming section when the image bearing member is in an initial state, the pattern forming section forms a black toner layer on the image bearing member to form the registration correction pattern on the black toner layer, the position correction section specifies, as a second reference position, a position of each of the patch images of the respective colors included in the registration correction pattern formed on the black toner layer, and in a registration correction carried out when the image bearing member is in a time-elapsed state that is a state after the initial state, the position correction section specifies the position of each of the patch images of the respective colors included in the registration correction pattern that is formed by the pattern forming section at the time of the registration correction and corrects the correction amount specified in the registration correction and to be applied to each of the image forming positions for the respective colors, the correction being performed based on the first reference position and the second reference position.

2. An image forming apparatus according to claim 1, wherein the position correction section specifies, as a first reference glossiness, a glossiness of the image bearing member in the initial state and specifies, as a second reference glossiness, a glossiness of the black toner layer both based on the sensor output, and in the registration correction carried out when the image bearing member is in the time-elapsed state that is the state after the initial state, the position correction section specifies a glossiness of the image bearing member, and corrects the correction amount specified in the registration correction to be applied to each of the image forming positions for the respective colors, the correction being performed based on the glossiness specified in the registration correction, the first reference glossiness, and the second reference glossiness.

3. An image forming apparatus according to claim 2, wherein the glossiness is defined as a ratio or a difference in intensity between the specular reflection components and the diffuse reflection components in the reflected light.

4. An image forming apparatus according to claim 1, wherein the image bearing member is an intermediate transfer belt made of thermoplastic polyurethane.

5. An image forming apparatus according to claim 1, wherein the black toner layer is lower in density than the patch images of the respective colors.

6. An image forming apparatus according to claim 1, wherein the black toner layer is formed to be larger in area than the registration correction pattern.

7. An image forming apparatus according to claim 1, wherein the registration correction pattern includes a black patch image, a yellow patch image, a cyan patch image, and a magenta patch image.

* * * * *